United States Patent [19]

Holston

[11] 4,378,933

[45] Apr. 5, 1983

[54] CRANE ASSEMBLY

[75] Inventor: Robert E. Holston, Moorestown, N.J.

[73] Assignee: The United States of America as represented by the Secretary of the Army, Washington, D.C.

[21] Appl. No.: 166,720

[22] Filed: Jul. 7, 1980

[51] Int. Cl.[3] ..... B66D 3/04

[52] U.S. Cl. ..... 254/399; 52/148

[58] Field of Search ..... 254/280–281, 254/283–286, 324–327, 334–338, 399, 413–415; 212/223; 52/116, 120, 148; 114/89–101

[56] References Cited

U.S. PATENT DOCUMENTS

| | | | |
|---|---|---|---|
| 1,109,148 | 9/1914 | Rudd et al. | 254/399 |
| 1,985,509 | 12/1934 | Lemont | 52/148 X |
| 2,203,113 | 6/1940 | Uecker et al. | 254/338 X |
| 2,557,852 | 6/1951 | Winkel | 212/223 X |
| 2,581,351 | 1/1952 | Black | 52/148 |
| 2,705,061 | 3/1955 | Getz | 52/148 X |
| 2,736,398 | 2/1956 | Peterson | 52/148 X |

FOREIGN PATENT DOCUMENTS

| | | | |
|---|---|---|---|
| 1212959 | 11/1970 | United Kingdom | 254/335 |

*Primary Examiner*—John M. Jillions

*Attorney, Agent, or Firm*—Nathan Edelberg; Jeremiah G. Murray; John W. Redman

[57] ABSTRACT

The device features the elimination of bending moments in all members to allow a design of minimal weight, and depends on the use of an existing structure to provide stabilizing reactions when erected. A rigid mast is pivoted at its lower end on the existing structure, and supports a block and tackle at its upper end. A rigid triangular spreader and cable assemblies support the mast.

3 Claims, 9 Drawing Figures

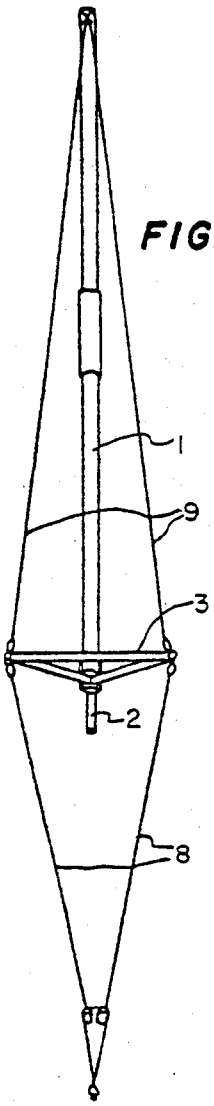
FIG. 3
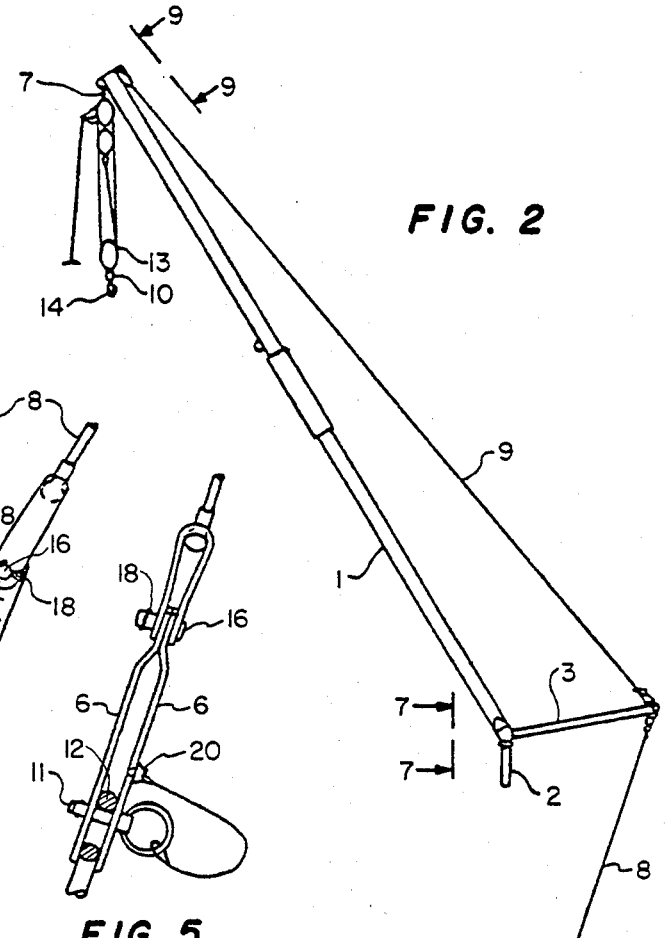
FIG. 2
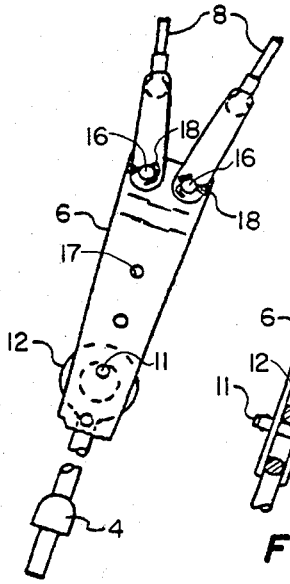
FIG. 4
FIG. 5
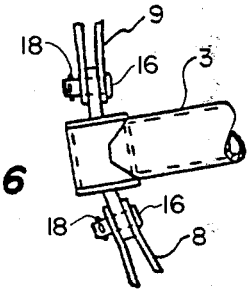
FIG. 6
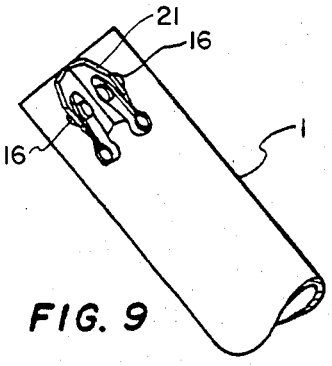
FIG. 9
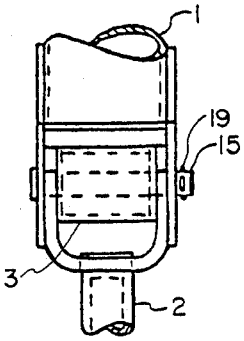
FIG. 7
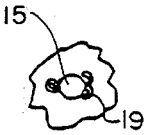
FIG. 8

CRANE ASSEMBLY

BACKGROUND OF THE INVENTION

This invention relates to a crane assembly, and more particularly to hoisting apparatus for use on an existing structure.

Hoisting cranes comprising assemblies of masts, booms and cables are of course well known. One example is shown in U.S. Pat. No. Re. 20,551 to W. E. Rouse for Mooring and Hoisting Apparatus on a ship for lifting objects from the surface of the sea.

The principal object of the present invention is to provide a crane assembly of minimum weight.

SUMMARY OF THE INVENTION

The feature of the invention is the achievement of a minimum weight crane structure by the elimination of bending moments in all members and the use of existing structures (not part of the crane assembly) to provide stabilizing reactions when erected.

The invention consists of a rigid boom, having a block and tackle at its free end and being pin connected to a freely rotating pivot post at its restrained end. The pivot post is mounted to a support base which acts as a rigid body and provides reaction forces for all members of the crane assembly. The boom is held in its erect position through the use of a triangular shaped spreader assembly and an upper and lower cable assembly. The spreader assembly is pin connected at one of its corners to the pivot post at the same point as is the boom and is constrained at that point in the same manner as is the boom.

The crane assembly of the invention requires a minimal number of parts and consists of a rigid boom, a block and tackle, a pivot post, a triangular shaped spreader assembly and an upper and lower cable assembly. When the crane is assembled one end of the boom attaches to the block and tackle. The other end of the boom, along with one corner of the spreader assembly is pin connected to the pivot post. The pivot post itself is mounted to a support base in such a manner as to be freely rotatable through a 360 degree angle. The support base is not part of the crane assembly and may be any rigid body capable of providing reaction forces for all members of the crane assembly. The boom is held in its erect position through the use of the upper and lower cable assemblies which attach to the remaining two corners of the spreader assembly.

BRIEF DESCRIPTION OF THE DRAWING

FIG. 2 is a side elevational view of the crane assembly;

FIG. 3 is a front elevational view of the same crane assembly;

FIG. 4 is an enlarged front view of a quadrant selector portion taken along lines 4—4 of FIG. 2;

FIG. 5 is an enlarged side view of the portion of the assembly shown in FIG. 4;

FIG. 6 is an enlarged view of a corner junction of the upper and lower cable assemblies and the spreader;

FIG. 7 is an enlarged view along lines 7—7 of FIG. 2, showing the pivot post attached to the mast;

FIG. 8 is a partial side view of FIG. 7 showing the end of the hinge pin; and FIG. 9 is an enlarged view along lines 9—9 of FIG. 2, showing the detail at the top of the mast where the block and tackle is attached.

DETAILED DESCRIPTION

Figure 1:
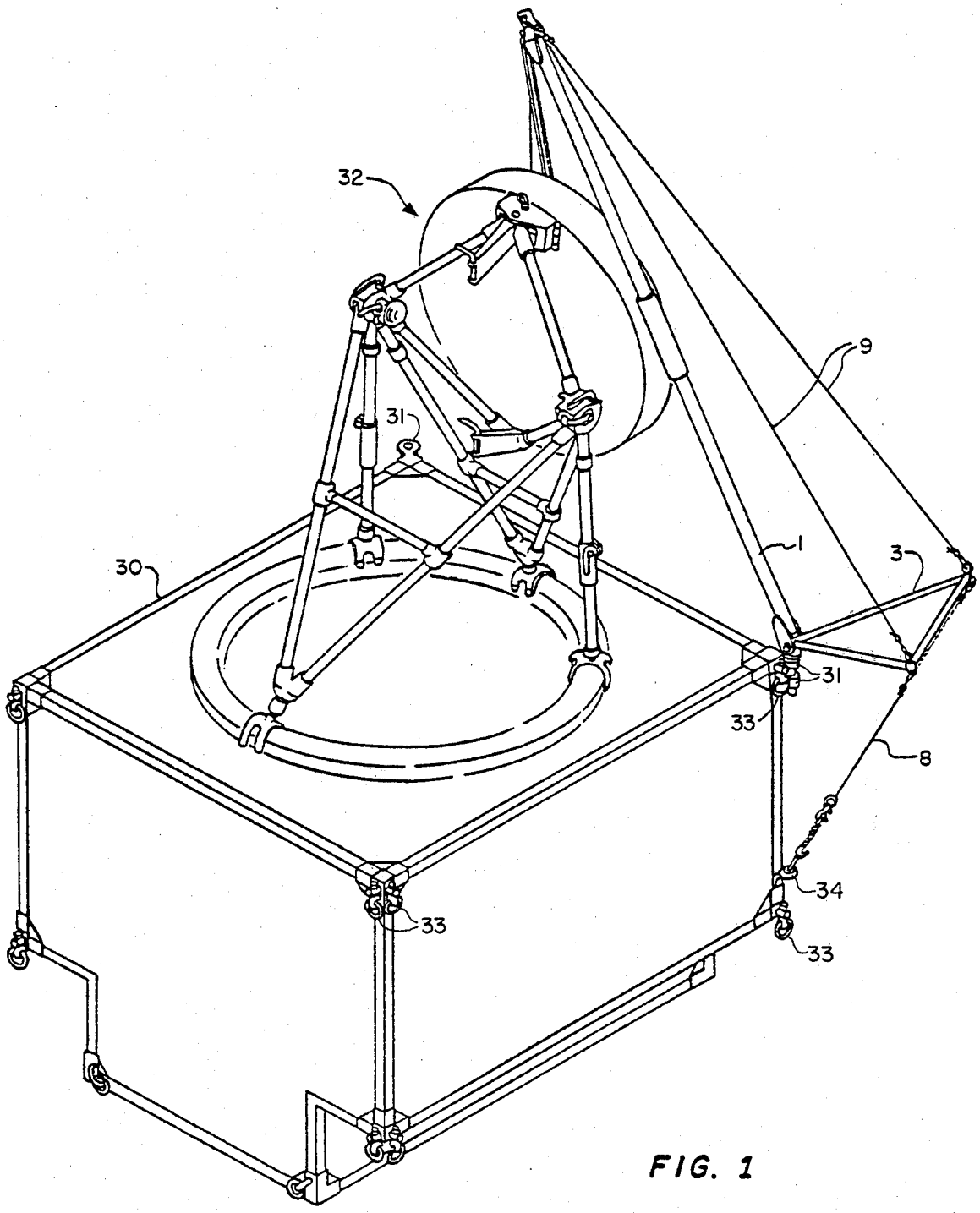
FIG. 1 is a pictorial view of a crane assembly mounted on a shelter to erect an antenna structure.

The crane assembly described herein is used to lift components of a military antenna system from a stowed condition inside a communications shelter to the roof of the shelter as part of an antenna erection procedure. The principle employed could be used wherever a crane type device is required. The unique feature of the device is the achievement of a minimum weight crane structure by the elimination of bending moments in all crane members and the use of existing structures (not part of crane assembly) to provide stabilizing reactions when erected and used.

FIG. 1 shows the crane assembly erected on the portable electronics shelter 30 where it is used to lift components of an antenna assembly 32 from the ground to the roof of the shelter. In this application, the shelter acts as the support base for the crane. The pivot post mounts in a hole in one of two special corner castings 31 of the shelter. These castings also contain shelter lift rings 33. The shelter also contains lower swivel mount 34.

As shown in FIGS. 2–9 the crane is constructed as follows:

Spherical nut 4 which fits into swivel mount 34 is attached to lower pivot pin 12. Pivot pin 12 is engaged in quadrant selector 6 by detent pin 11 which is restrained by lanyard and CSK head screw 20 and inserted through quadrant selector 6 through one of adjustment holes 17 (only one indicated). The quadrant selector 6 joins to lower cable assembly 8 by pins 16 and cotter pins 18. The other end of assembly 8 joins to spreader 3 with two more pins 16 and cotter pins 18. Triangular spreader 3 is also joined to upper cable 9 on two points by two more pins 16 and cotter pins 18 and to pivot post 2 and mast 1 by pin 15 and cotter pin 19 on the third point. The other ends of upper cable assembly 9 join to mast 1 by top anchor 21 and held by pins 16 and cotter pins 18. The lifting components used are conventional and are illustrated as follows: Block and tackle 13 attaches to mast 1 by means of chain shackle round pin 7 and safety snap hook 14 to the lower block by shackle 10.

The lightweight nature of this crane makes it easy for two men to erect. The assembly weighs 18 pounds.

FIGS. 2–9 show the detail parts of the crane assembly. The mast 1, the pivot 2, and the spreader 3 are the only rigid members in the assembly. The mast 1 acts in compression at all times and transmits the working loads from the block and tackle 13 to the pivot post 2. The pivot post must be mounted in a support base corner casting 31 and be free to rotate. The lower end of the mast 1 is pinned to the pivot post 2 by pin 15, restrained by cotter pin 19. The mast is held in its erect position by the upper cable assembly 9 and the lower cable assembly 8. Cable assemblies 8 and 9 act in tension only and transmit working loads to lower swivel mount 34. The attachment point of the lower cable assembly must be to the same support base to which the pivot post is attached. The support base acts as a rigid body and provides the necessary reaction forces to the pivot post 2 and the lower cable assembly 8. The support base, although not part of the crane assembly, must be provided at the location of erection. To permit the erected crane assembly to pivot in azimuth, the attachment point 34 of the lower cable assembly 8 to the support base must be on the same vertical axis line as the pivot post 2. This attachment is made with a spherical nut 4 to provide freedom of rotation.

The reach of the mast 1 is set and adjusted by selecting a hole 17 in the quadrant selector 6 and capturing the lower pivot pin 12 with the detent pin 11.

What is claimed is:

1. A crane assembly for use with a structure having a mounting hole and an attachment point, with the mounting hole located vertically above the attachment point; said crane assembly comprising:

a rigid mast having upper and lower ends;

a spreader having three rigid sides joined at first, second and third corners, with the first corner attached to the lower end of said mast;

a pivot post for insertion in said mounting hole, the pivot post being attached to the lower end of the mast by a hinge pin;

a lower cable assembly comprising two cables attached respectively to the second and third corners of said spreader, and attached at the other ends to connecting means, which in turn is attached to said attachment point;

an upper cable assembly comprising two cables attached respectively to the second and third corners of said spreader, and attached at the other ends to the upper end of said mast;

and hoisting means including at least one pulley attached to the upper end of said mast.

2. A crane assembly as set forth in claim 1, wherein said hoisting means comprises a block and tackle.

3. A crane assembly as set forth in claim 1 or 2, wherein said connecting means of the lower cable assembly comprises a quadrant selector which includes plate means to which the two cables are attached, the plate means having a series of holes, a lower pivot pin having an eye and means attaching it to said attachment point with a spherical nut to provide freedom of rotation, and a detent pin which is inserted through said eye and a selected one of said series of holes, which thereby provides for adjustment of the reach of the mast.

* * * * *